US011098557B2

(12) United States Patent
Hoffman

(10) Patent No.: US 11,098,557 B2
(45) Date of Patent: Aug. 24, 2021

(54) LINER WIPER PLUG WITH RUPTURE DISK FOR WET SHOE

(71) Applicant: Josef Hoffman, Midland, TX (US)

(72) Inventor: Josef Hoffman, Midland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 62 days.

(21) Appl. No.: 16/563,031

(22) Filed: Sep. 6, 2019

(65) Prior Publication Data

US 2021/0071500 A1 Mar. 11, 2021

(51) Int. Cl.
*E21B 34/06* (2006.01)
*E21B 33/12* (2006.01)

(52) U.S. Cl.
CPC ..... *E21B 34/063* (2013.01); *E21B 33/12* (2013.01)

(58) Field of Classification Search
CPC ..... E21B 17/14; E21B 33/12; E21B 33/16; E21B 33/165; E21B 33/167; E21B 34/063
See application file for complete search history.

(56) References Cited

U.S. PATENT DOCUMENTS 5,437,330 A * 8/1995 Gambertoglio ..... E21B 33/16 166/289
5,762,139 A * 6/1998 Sullaway ..... E21B 33/16 166/291
2013/0118752 A1 5/2013 Hannegan et al.
2013/0333873 A1 12/2013 Giroux et al.
2014/0102723 A1* 4/2014 Stair ..... E21B 33/14 166/386
2017/0067304 A1 3/2017 Turley et al.
2017/0314365 A1* 11/2017 Ojong ..... E21B 34/063

FOREIGN PATENT DOCUMENTS

WO 9931349 A1 6/1999
WO 2013115948 A1 8/2013

OTHER PUBLICATIONS

International Search Report and Written Opinion for International Application No. PCT/US2020/049014; International Filing Date Sep. 2, 2020; dated Dec. 4, 2020; 11 Pages.

* cited by examiner

*Primary Examiner* — David Carroll
(74) *Attorney, Agent, or Firm* — Cantor Colburn LLP

(57) ABSTRACT

A plug for delivering to a bottom end of a tubular in a wellbore and method of use. The plug includes a body having a first end and a second end opposite the first end, the first end engageable to a landing member in an interior of the tubular uphole of the bottom end. A bore extends through the body from the first end to the second end. A rupture disk that breaks above a rupture threshold pressure is on an outer diameter of the body. The plug is run into the tubular and engaged to the landing member. A hydraulic pressure is applied in the tubular to rupture the rupture disk to form an inlet to the plug. Fluid is delivered to the bottom end of the tubular via the inlet of the plug.

14 Claims, 3 Drawing Sheets

LINER WIPER PLUG WITH RUPTURE DISK FOR WET SHOE

BACKGROUND

In the resource recovery industry, a completion process includes cementing a casing into a wellbore. The cementation processing includes places a float shoe at a bottom of the casing and passes cement through the casing and float shoe to having the cement travel up through an annulus between eh casing and a wellbore wall. Once the cementation process is complete, it is desirable to flush the float shoe of residual cement. This required developing a fluid path through various components between the surface and the bottom end of the casing, such as a landing collar. Landing collars generally have moving parts for creating such as fluid path, which leads to mechanical difficulties. Accordingly, there is a need to create a fluid path through a landing collar with reduced mechanical complexity.

SUMMARY

In one aspect, a method of delivering a fluid to a bottom end of a tubular in a wellbore is disclosed. A plug is run into the tubular, the plug including a body having a bore therethrough and a rupture disk on the body, the tubular including a landing member within its interior uphole of the bottom end. The plug is engaged to the landing member, and a hydraulic pressure is applied in the tubular to rupture the rupture disk to form an inlet to the plug. Fluid is delivered to the bottom end of the tubular via the inlet of the plug.

In another aspect, a plug for delivering to a bottom end of a tubular in a wellbore is disclosed. The plug includes a body having a first end and a second end opposite the first end, the first end engageable to a landing member in an interior of the tubular uphole of the bottom end, a bore extending through the body from the first end to the second end, and a rupture disk on an outer diameter of the body, the rupture disk having a rupture threshold pressure above which the rupture disk breaks.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
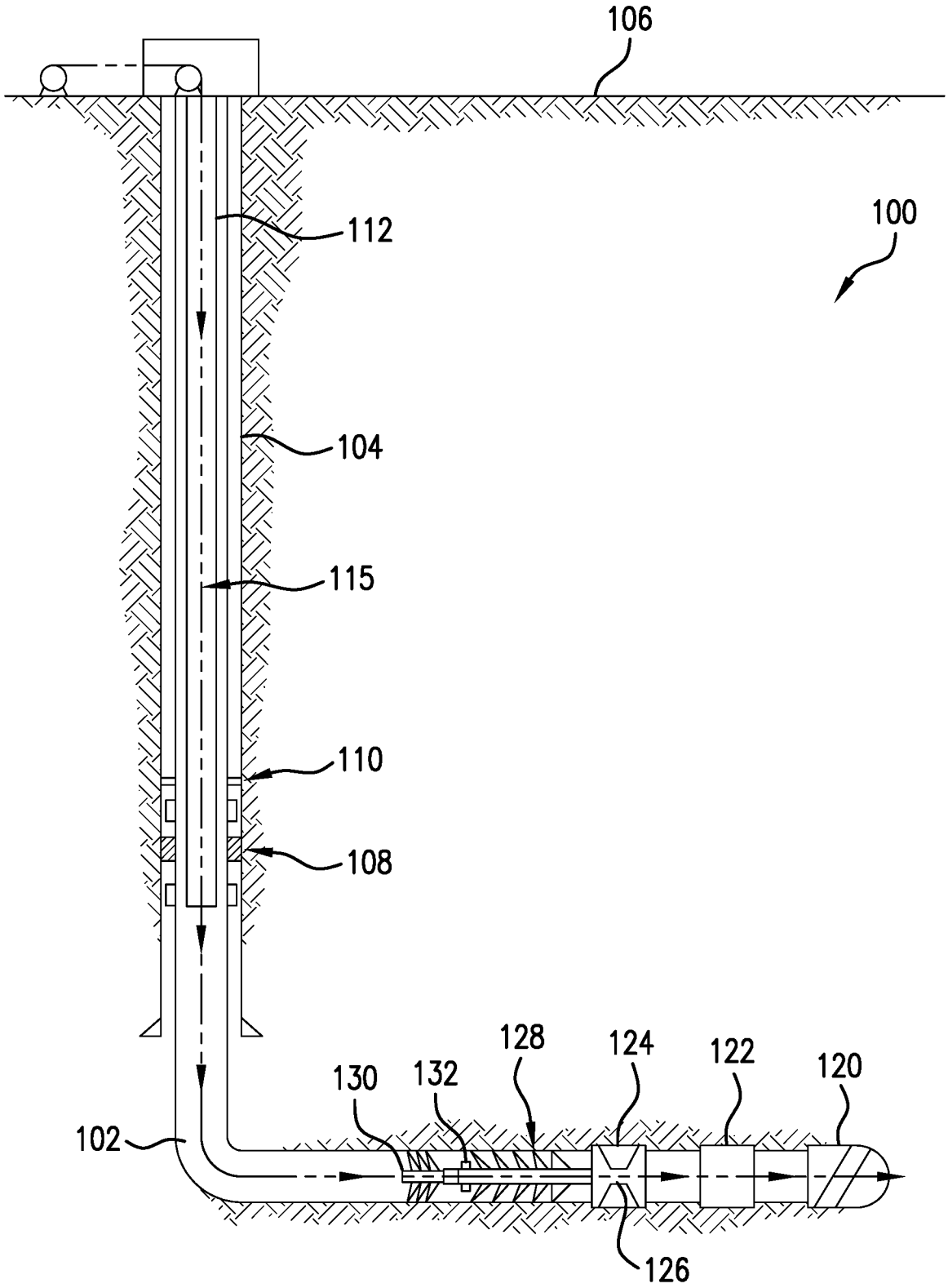
FIG. 1 shows a downhole system for cementing a casing into a wellbore, in an embodiment.

Referring to FIG. 1, a downhole system 100 for cementing a casing into a wellbore 102 is shown in an embodiment. The downhole system 100 includes a host casing 104 extending from a surface 106 to a selected downhole location. A tubular 108 is affixed to an interior surface of the host casing 104 via a top packer 110 and/or other suitable attachment device and extends into the wellbore below the bottom end of the host casing 104. The tubular 108 can be a liner hanger, a casing or any other such tubular member. A conduit or pipe 112 extends from the surface 106 to a location within the tubular and a fluid or cement can be delivered downhole via the pipe 112.

As assembly of cementing equipment is disposed at a bottom end of the tubular 108 used to cement the tubular into the wellbore 102. The cementing equipment includes a float shoe 120 and float collar 122. The float shoe 120 is affixed to a bottom end of the tubular 108 and includes an aperture and check valve that allow a fluid or cement to pass through the float shoe in one direction. A float collar 122 is installed in the tubular 108 above the float shoe 120. The float collar 122 also includes a check valve to prevent back flow of cement or other fluid. A column of cement is pumped via pipe 112 through the tubular 108 to exit into the wellbore via the aperture of the float shoe 120. The cement then flows up through an annulus on the outside of the tubular 108 in order to cement the tubular into place in the wellbore 102. A landing member 124 such as a landing collar is then coupled or secured to an inside surface of the tubular 108 at a location above the float collar 122. The landing member 124 includes an aperture 126 to allow passage of a fluid. A liner wiper plug 128 is shown disposed uphole of the landing member 124. The liner wiper plug 128 is engaged to the landing member 124 by lowering the liner wiper plug through the tubular 108. Engaging the liner wiper plug 128 to the landing member 124 produces a passage for a fluid to flow through the landing member 124, float collar 122 and float shoe 120 at a bottom end of the tubular. The liner wiper plug 128 includes a rupture disk 132 that ruptures to produce the flow passage. A pump down plug 130 is inserted in the uphole end of the liner wiper plug 128 to receive hydraulic pressure to push the liner wiper plug downhole.

Fluid path 115 shows a path for fluid through the tubular 108. The fluid is pumped from the surface 106 and passes through the pipe 112 and around the pump down plug 130 to enter the liner wiper plug via an inlet caused by rupture of the rupture disk 132. The fluid then passes out of the liner wiper plug 128 through the aperture 126 of the landing member 124 to flow through the float collar 122 and the float shoe 120 at the bottom end of the tubular 108. In various embodiments, the fluid is a flushing fluid used to clean the float shoe 120.

Figure 2:
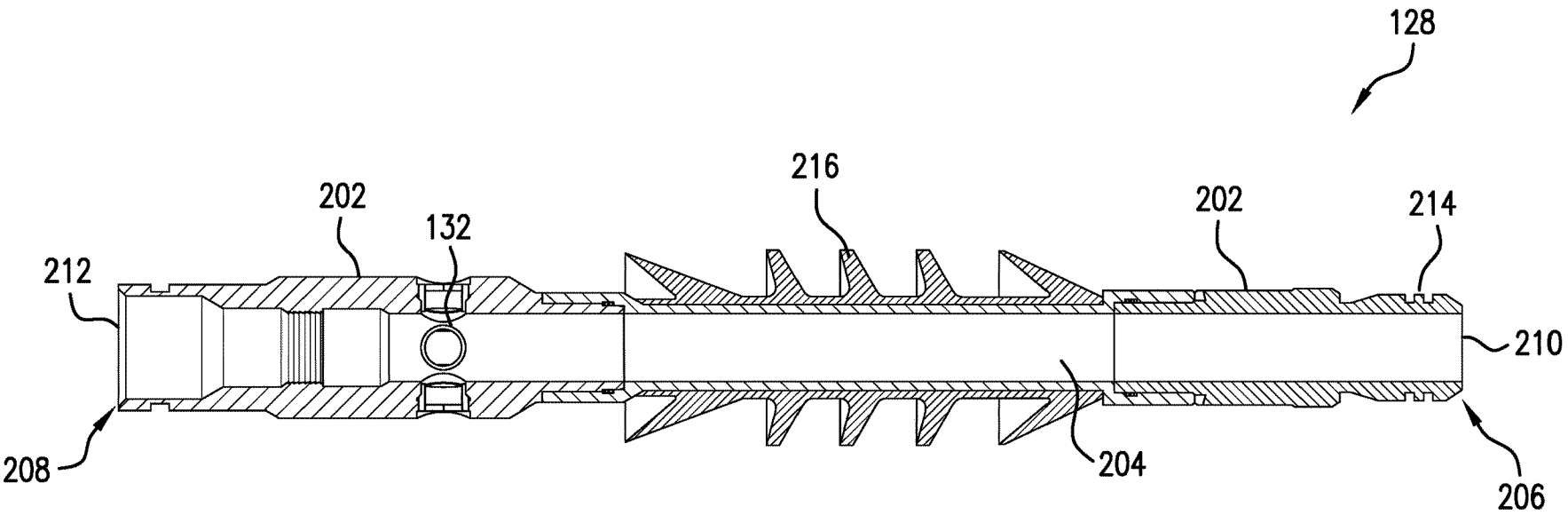
FIG. 2 shows a liner wiper plug in an embodiment.

FIG. 2 shows a liner wiper plug 128 in one embodiment. The liner wiper plug 128 includes a body 202 having a bore 204 extending from a first end 206 to a second end 208. The first end 206 includes an opening or outlet 210 and the second end include an opening 212. In various embodiments, the liner wiper plug 128 is placed in the wellbore with the first end 206 downhole of the second end 208. The body 202 supports one or more wiper fins 216 along its exterior surface in order to maintain the body 202 centrally located in the tubular 108 and to form a fluid barrier along the outside of the body 202 between fluid at the first end 206 of the body and fluid at the second end 208 of the body. The wiper fins 216 are molded rubber material that are shaped like a plate or a disc surrounding the body 202 of the liner wiper plug 128. The opening 212 at the second end 208 receives a pump down plug 130, which plugs the opening. The liner wiper plug 128 further includes a rupture disk 132 on an outer diameter of the body 202. The rupture disk 132 ruptures when a fluid pressure difference between the outside of the liner wiper plug 128 and the inside of the liner wiper plug 128 exceeds a predetermined rupture threshold pressure of the rupture disk. In various embodiment, the rupture disk 132 can refer to a single rupture disk or a plurality of rupture disks, as shown in FIG. 2.

In order to engage the liner wiper plug 128 to the landing member 124, the liner wiper plug is lowered through the tubular 108 with its first end 206 downhole. The pump down plug 130 is placed in the body 202 of the liner wiper plug 128 at the second end 208 to plug the opening 212. A fluid pressure is then applied at the pump down plug 130 in order to force the assembly of the pump down plug 130 and liner wiper plug 128 downhole. When the liner wiper plug 128 reaches the landing member 124, the first end 206 of the body 202 engages to the aperture 126 of the landing member 124. In various embodiments, a latch 214 of the liner wiper plug 128 engages a similar engagement device of the landing member 124 to secure the liner wiper plug to the landing member. Once the liner wiper plug 128 is secured to the landing member 124, the rupture disk 132 can be broken in order to establish a fluid path through the landing member 124.

The liner wiper plug 128 is lowered into the landing member 124 by applying a hydraulic pressure at a first pressure. The first pressure is less than the rupture threshold pressure of the rupture disk 132. Once the liner wiper plug 128 is secured to the landing member 124, one or more pressure tests can be performed by raising the hydraulic pressure to a testing pressure (a second pressure) that is between the first pressure and the rupture threshold pressure. After the one or more pressure tests have been performed, the hydraulic pressure can be raised to a third pressure above the rupture threshold pressure of the rupture disk 132, thereby breaking the rupture disk to form an inlet.

Figure 3:
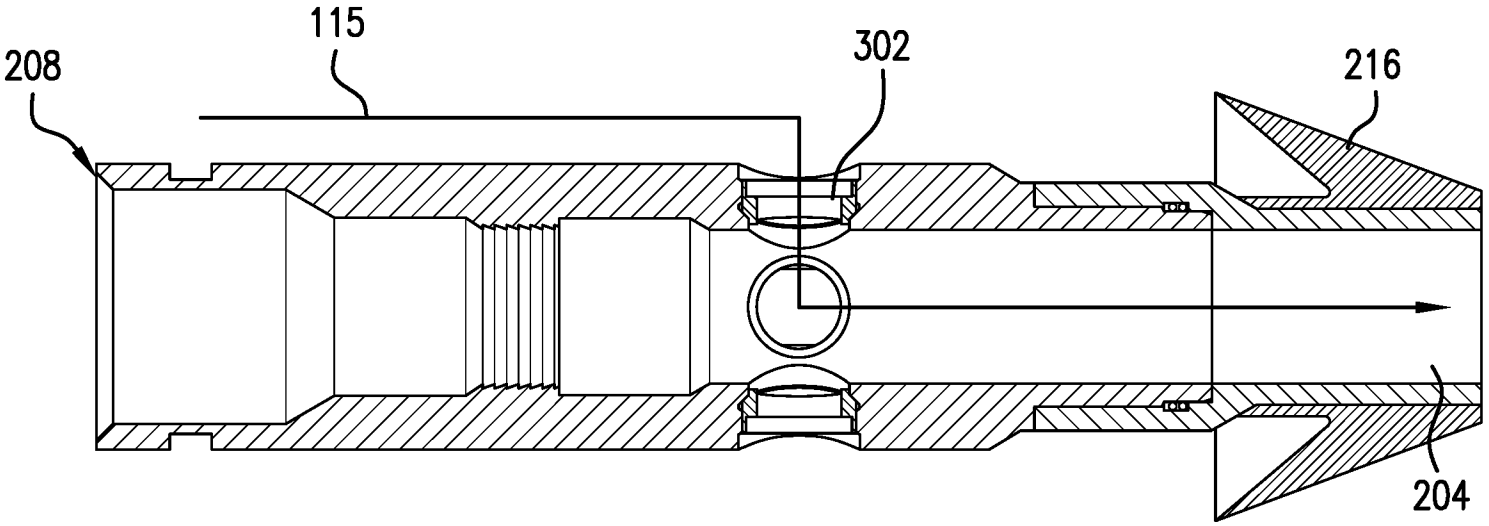
FIG. 3 shows a portion of fluid path created at the liner wiper plug by rupture of a rupture disk.

FIG. 3 shows a portion of fluid path 115 created at the liner wiper plug 128 by rupture of the rupture disk 132. The fluid path 115 passes from the exterior of the liner wiper plug 128 at a location above the wiper fins 216 through the inlet 302 and bore 204 of the liner wiper plug 128 to pass out of the bore via the outlet 210 at the first end 206 of the liner wiper plug. A fluid can then be delivered to the float shoe 120 via this fluid path 115, with the fluid passing out of the liner wiper plug 128 to pass through the landing member 124, the float collar 122 and the float shoe 120, thereby cleaning out the float shoe 120.

Set forth below are some embodiments of the foregoing disclosure:

Embodiment 1. A method of delivering a fluid to a bottom end of a tubular in a wellbore, comprising: running a plug into the tubular, the plug including a body having a bore therethrough and a rupture disk on the body, the tubular including a landing member within its interior uphole of the bottom end; engaging the plug to the landing member; applying a hydraulic pressure in the tubular to rupture the rupture disk to form an inlet to the plug; deliver the fluid to the bottom end of the tubular via the inlet of the plug.

Embodiment 2. The method according to any prior embodiment, wherein the rupture disk is located on an outer diameter of the body.

Embodiment 3. The method according to any prior embodiment, further comprising applying the hydraulic pressure to an exterior of the plug to rupture the rupture disk.

Embodiment 4. The method according to any prior embodiment, further comprising applying the hydraulic pressure to the plug at a first pressure to engage a first end of the plug to the landing member.

Embodiment 5. The method according to any prior embodiment, wherein engaging the first end to the landing member aligns an outlet at the first end to an aperture of the landing member.

Embodiment 6. The method according to any prior embodiment, further comprising applying the hydraulic pressure to the engaged plug at a second pressure to perform downhole pressure testing above the landing member, the second pressure being greater than the first pressure and less than the rupture threshold pressure.

Embodiment 7. The method according to any prior embodiment, the rupture disk having a rupture threshold pressure, the method further comprising applying the hydraulic pressure at a third pressure greater than or equal to the rupture threshold pressure to rupture the rupture disk.

Embodiment 8. A plug for delivering to a bottom end of a tubular in a wellbore, comprising: a body having a first end and a second end opposite the first end, the first end engageable to a landing member in an interior of the tubular uphole of the bottom end; a bore extending through the body from the first end to the second end; and a rupture disk on an outer diameter of the body, the rupture disk having a rupture threshold pressure above which the rupture disk breaks.

Embodiment 9. The plug according to any prior embodiment, wherein the rupture disk is configured to break via a hydraulic pressure applied to an exterior of the body above the rupture threshold pressure.

Embodiment 10. The plug according to any prior embodiment, further comprising a latch at the first end for engaging the landing member.

Embodiment 11. The plug according to any prior embodiment, wherein the first end engages the landing member to align an outlet at the first end to an aperture of the landing member.

Embodiment 12. The plug according to any prior embodiment, wherein breaking the rupture disk forms an inlet in the body for allowing a fluid path through the plug.

Embodiment 13. The plug according to any prior embodiment, wherein the inlet allows a fluid to flow from the wellbore above the landing member into the bore and an outlet at the first end allows the fluid to flow out of the bore.

Embodiment 14. The plug according to any prior embodiment, wherein the rupture threshold pressure of the rupture disk is greater than a first pressure for engaging the plug to the landing member and second pressure for pressure testing the engaged plug.

Embodiment 15. The plug according to any prior embodiment, wherein the second pressure is greater than the first pressure and less than the rupture threshold pressure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of cleaning a shoe at a bottom end of a tubular in a wellbore, comprising:

running a plug into the tubular to displace a cement from the interior of the tubular through the bottom, end, the tubular including a landing member within its interior uphole of the bottom end, the plug including a body having a bore therethrough and a rupture disk on the body;

engaging the plug to the landing member;

applying a hydraulic pressure in the tubular to rupture the rupture disk to form an inlet to the plug; and delivering a flushing fluid to the bottom end of the tubular via the inlet of the plug to clean the shoe.

2. The method of claim 1, wherein the plug includes a first end downhole of the second end and a wiper fin between the first end and the second end, and the rupture disk is located on an outer diameter of the body at the second end, further comprising engaging the first end of the plug to the landing member.

3. The method of claim 2, further comprising applying the hydraulic pressure to flushing fluid at the second end of the plug to rupture the rupture disk.

4. The method of claim 1, further comprising applying the hydraulic pressure to the plug at a first pressure to engage a first end of the plug to the landing member.

5. The method of claim 4, wherein engaging the first end to the landing member aligns an outlet at the first end to an aperture of the landing member.

6. The method of claim 4, further comprising applying the hydraulic pressure to the engaged plug at a second pressure to perform downhole pressure testing above the landing member, the second pressure being greater than the first pressure and less than the rupture threshold pressure.

7. The method of claim 6, the rupture disk having a rupture threshold pressure, the method further comprising applying the hydraulic pressure at a third pressure greater than or equal to the rupture threshold pressure to rupture the rupture disk.

8. A plug for cleaning a shoe at a bottom end of a tubular in a wellbore, comprising:

a body having a first end and a second end opposite the first end, the first end engageable to a landing member in an interior of the tubular uphole of the bottom end to displace cement from the interior of the tubular through the bottom end;

a bore extending through the body from the first end to the second end; and a rupture disk on an outer diameter of the body, the rupture disk having a rupture threshold pressure above which the rupture disk breaks to form an inlet through which a flushing fluid can be delivered to the bottom end of the tubular to clean the shoe.

9. The plug of claim 8, wherein the rupture disk is configured to break via a hydraulic pressure applied to the flushing fluid at the second end of the body above the rupture threshold pressure.

10. The plug of claim 8, further comprising a latch at the first end for engaging the landing member.

11. The plug of claim 8, wherein the first end engages the landing member to align an outlet at the first end to an aperture of the landing member.

12. The plug of claim 8, wherein the inlet allows the flushing fluid to flow from the wellbore above the landing member into the bore and an outlet at the first end allows the flushing fluid to flow out of the bore.

13. The plug of claim 8, wherein the rupture threshold pressure of the rupture disk is greater than a first pressure for engaging the plug to the landing member and second pressure for pressure testing the engaged plug.

14. The plug of claim 13, wherein the second pressure is greater than the first pressure and less than the rupture threshold pressure.

* * * * *